US011661292B2

(12) United States Patent
Harada et al.

(10) Patent No.: US 11,661,292 B2
(45) Date of Patent: May 30, 2023

(54) PAPER FEEDER, IMAGE FORMING APPARATUS, AND NON-TRANSITORY COMPUTER READABLE MEDIUM

(71) Applicant: FUJIFILM BUSINESS INNOVATION CORP., Tokyo (JP)

(72) Inventors: Shinya Harada, Kanagawa (JP); Hirotaka Sato, Kanagawa (JP); Kenji Tomizawa, Kanagawa (JP); Hirofumi Ogasawara, Kanagawa (JP); Katsuyuki Fujii, Kanagawa (JP); Takayoshi Sato, Kanagawa (JP); Ryoji Kawaguchi, Kanagawa (JP); Junichi Furusawa, Kanagawa (JP); Daiji Kato, Kanagawa (JP); Yuichi Hoshino, Kanagawa (JP); Masashi Hara, Kanagawa (JP); Yuki Akechi, Kanagawa (JP); Shinichi Kinoshita, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 211 days.

(21) Appl. No.: 17/108,075

(22) Filed: Dec. 1, 2020

(65) Prior Publication Data

US 2021/0362970 A1 Nov. 25, 2021

(30) Foreign Application Priority Data

May 25, 2020 (JP) ..... JP2020-090378

(51) Int. Cl.
*B65H 1/26* (2006.01)
*B65H 3/06* (2006.01)

(52) U.S. Cl.
CPC ..... *B65H 1/26* (2013.01); *B65H 3/06* (2013.01)

(58) Field of Classification Search
CPC ..... B65H 1/26; B65H 3/06; B65H 2601/322; B65H 2301/42134
See application file for complete search history.

(56) References Cited

U.S. PATENT DOCUMENTS

| | | | | |
|---|---|---|---|---|
| 5,794,928 | A * | 8/1998 | Araseki | B65H 1/04 271/157 |
| 7,604,232 | B2 * | 10/2009 | Nakashima | B65H 1/26 271/164 |
| 7,681,879 | B2 * | 3/2010 | Fuchi | B65H 1/04 271/157 |
| 10,046,929 | B1 * | 8/2018 | Gunnell | H04N 1/00604 |
| 10,364,119 | B2 * | 7/2019 | Uchibori | B65H 31/10 |
| 2022/0356034 | A1 * | 11/2022 | Henderickx | B65H 31/3054 |

FOREIGN PATENT DOCUMENTS

| | | | |
|---|---|---|---|
| JP | 2005-247440 | A | 9/2005 |
| JP | 2007-145563 | A | 6/2007 |
| JP | 2017154850 | A * | 9/2017 |

* cited by examiner

*Primary Examiner* — Howard J Sanders
(74) *Attorney, Agent, or Firm* — Oliff PLC

(57) ABSTRACT

A paper feeder includes a processor configured to, in a case of lowering a paper feed tray on which paper is placed in an accommodation section that accommodates paper and replenishing paper, the paper feed tray being controlled to be raised/lowered in a case of replenishing paper, control a lowering amount of the paper feed tray according to a number of sheets of paper to be replenished.

10 Claims, 12 Drawing Sheets

FIG. 5

| TYPE OF PAPER | THICKNESS (mm) |
|---|---|
| PLAIN PAPER | 0.08 |
| WOOD-FREE PAPER | 0.1 |
| RECYCLED PAPER | 0.08 |
| CARDBOARD 1 | 0.1 |
| CARDBOARD 2 | 0.2 |

PAPER HAS RUN OUT.
PLEASE REPLENISH 100 SHEETS OF PAPER ON TRAY 1.

PAPER FEEDER, IMAGE FORMING APPARATUS, AND NON-TRANSITORY COMPUTER READABLE MEDIUM

CROSS-REFERENCE TO RELATED APPLICATIONS

This application is based on and claims priority under 35 USC 119 from Japanese Patent Application No. 2020-090378 filed May 25, 2020.

BACKGROUND

(i) Technical Field

The present disclosure relates to a paper feeder, an image forming apparatus, and a non-transitory computer readable medium.

(ii) Related Art

Japanese Unexamined Patent Application Publication No. 2005-247440 discloses an image forming apparatus including: a paper replenishment signal generator and a position detection sensor that generates a stop position arrival signal. In response to generation of a paper replenishment signal, a raising/lowering drive unit operates to lower a paper loading section. When the paper loading section is loaded with paper, the position detection sensor detects the top position of an end face of the loaded paper, and, when the paper loading section is not loaded with paper, the position detection sensor detects the upper part of an end face of the paper loading section. When the top position of the end face of the paper or the upper part of the end face of the paper loading section reaches a certain stop position, a stop position arrival signal is generated to stop the operation of the raising/lowering drive unit, thereby allowing the paper loading section, which is being lowered, to stop at the certain stop position.

Japanese Unexamined Patent Application Publication No. 2007-145563 discloses an image forming apparatus in which, when recording paper on a paper mounting tray 20 runs out, the paper mounting tray 20 is lowered by the power of a motor 301 to a lower limit portion.

There is a paper feeder that, when replenishing paper in an image forming apparatus, uniformly lowers a paper feed tray where paper is placed to a certain stop position regardless of the number of sheets of paper to be replenished. However, if the paper feed tray is lowered to the certain stop position in the case of replenishing a small amount of paper, it takes a longer time than needed to raise/lower the paper feed tray, leading to a longer replenishing time for replenishing paper.

In addition, a paper feeder that manually raises/lowers a paper feed tray when replenishing paper is also available. However, when the paper feed tray is covered with a covering and the position of the paper feed tray is visually unrecognizable, it is difficult to stop the paper feed tray at an appropriate stop position. Therefore, in the case of manually raising/lowering the paper feed tray, the paper feed tray is generally lowered more than the amount of paper to be replenished, and then paper is replenished. As a result, it takes a longer time than needed to raise/lower the paper feed tray, leading to a longer replenishment time for replenishing paper.

SUMMARY

Aspects of non-limiting embodiments of the present disclosure relate to providing a paper feeder, an image forming apparatus, and a non-transitory computer readable medium capable of shortening the time for raising/lowering a paper feed tray where paper is placed as compared to the case of uniformly lowering the paper feed tray to a certain stop position or manually lowering the paper feed tray to a stop position.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a paper feeder including a processor configured to, in a case of lowering a paper feed tray on which paper is placed in an accommodation section that accommodates paper and replenishing paper, the paper feed tray being controlled to be raised/lowered in a case of replenishing paper, control a lowering amount of the paper feed tray according to a number of sheets of paper to be replenished.

BRIEF DESCRIPTION OF THE DRAWINGS

An exemplary embodiment of the present disclosure will be described in detail based on the following figures, wherein:

FIG. 5 is a diagram illustrating an example of data stored in a data storage unit of the image forming apparatus according to the exemplary embodiment;

DETAILED DESCRIPTION

Next, an exemplary embodiment will be described in detail with reference to the drawings.

Figure 1:
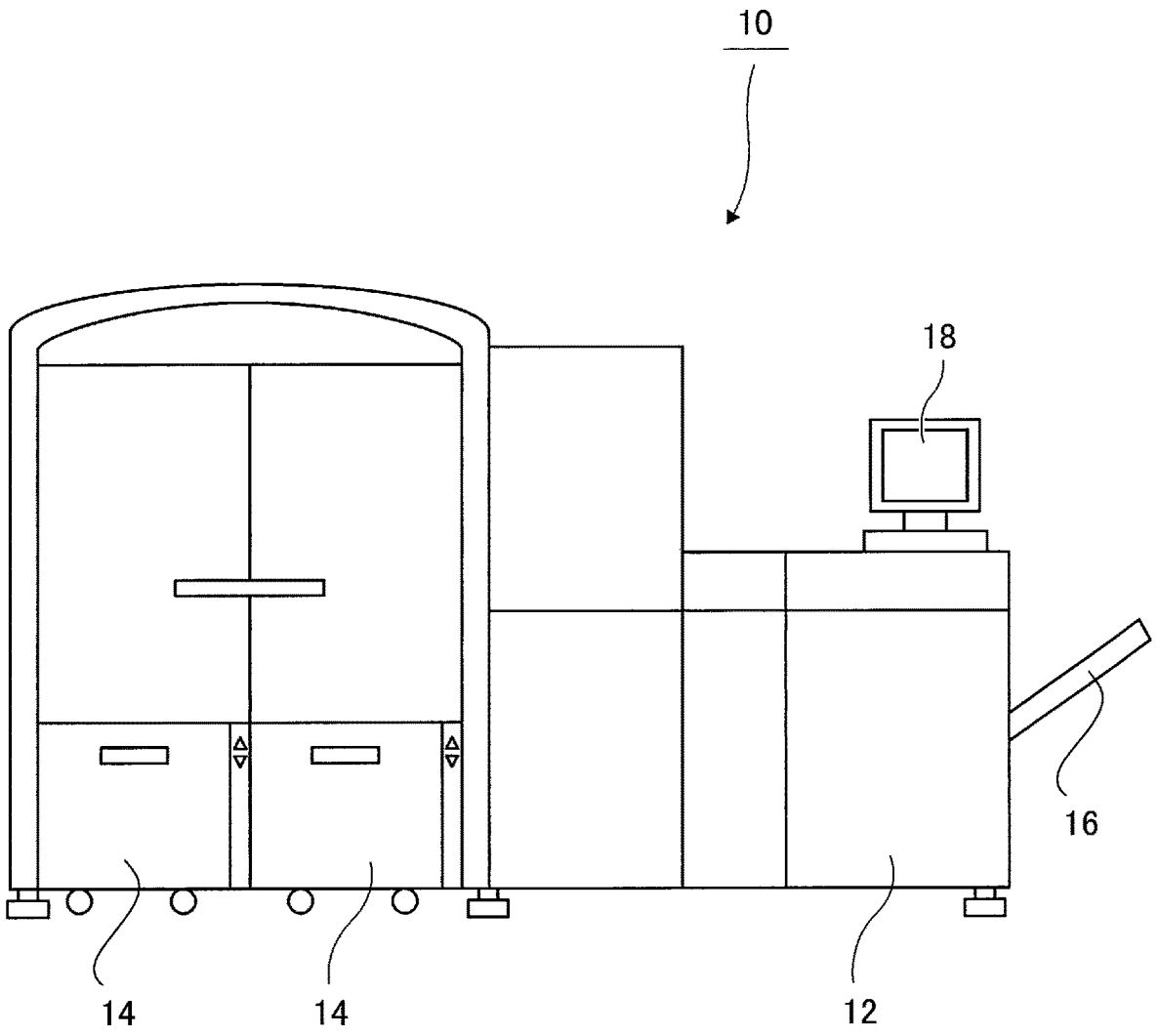
FIG. 1 is a side view illustrating an image forming apparatus according to an exemplary embodiment.
Figure 2:
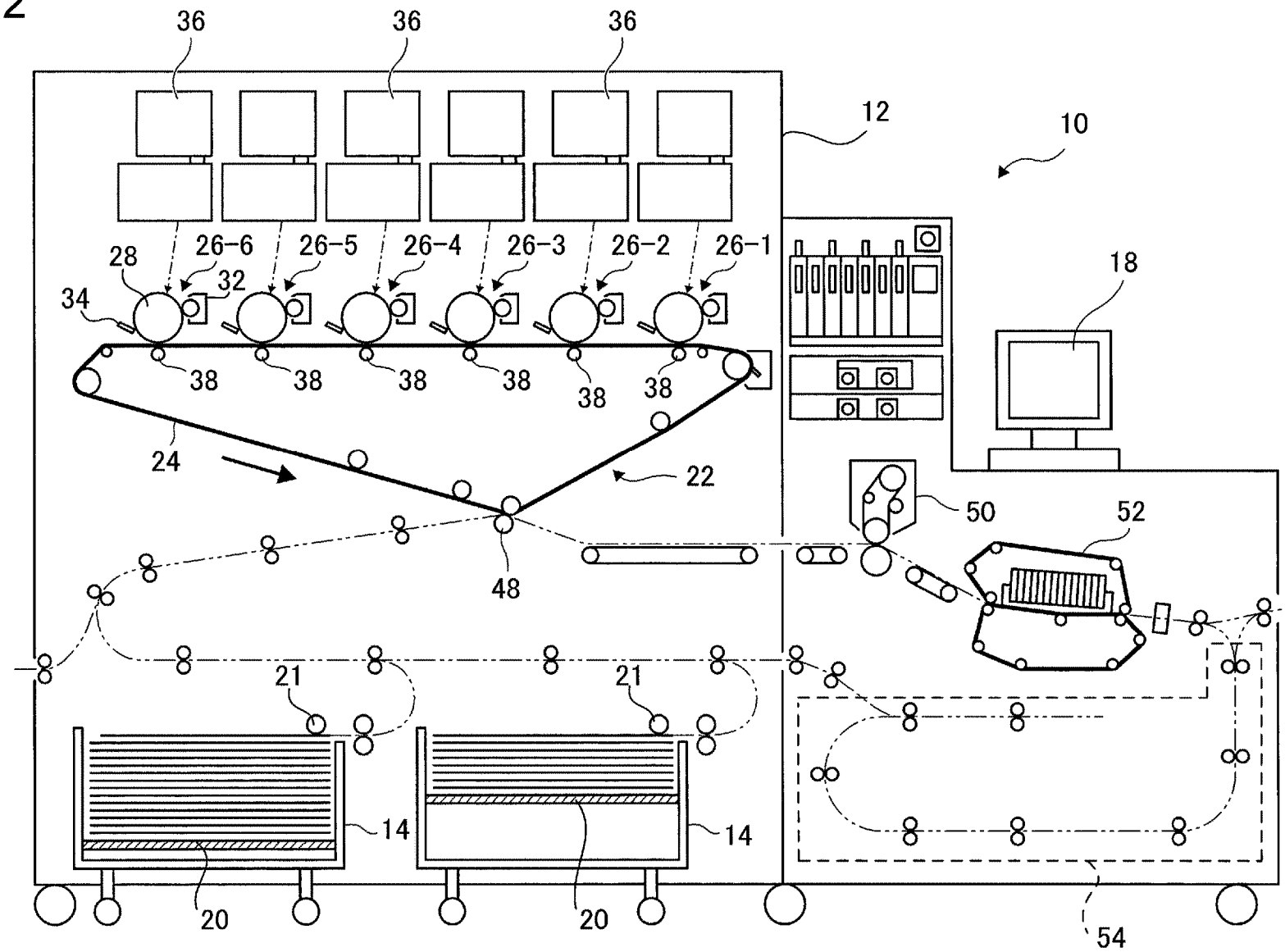
FIG. 2 is a side view of a partial cross section illustrating the image forming apparatus according to the exemplary embodiment.

FIG. 1 illustrates an image forming apparatus 10 according to the exemplary embodiment.

In FIG. 1, the image forming apparatus 10 includes an image forming apparatus main body 12, paper feeders 14, a paper delivery section 16, and a display operation section 18. The image forming apparatus main body 12 forms an image on paper or the like, which is a recording medium. The paper delivery section 16 ejects and stacks paper on which an image is formed by the image forming apparatus main body 12. The display operating section 18 includes a display screen and is configured to set the image forming apparatus 10.

The image forming apparatus main body 12 includes paper feed rollers 21, which are located above the paper feeders 14, while the paper feeders 14 are attached to the image forming apparatus main body 12. In addition, an image forming section 22, which forms an image on paper fed from the paper feeders 14, is provided above the paper feeders 14. The image forming apparatus 10 includes, for example, two paper feeders 14. The paper feeders 14 are configured to be capable of accommodating a large amount of paper and accommodating different types of paper and/or paper with different sizes. Paper placed on top of paper feed trays 20 of these paper feeders 14 is supplied, one sheet at a time, by the paper feed rollers 21 to the image forming section 22.

The image forming section 22 includes an intermediate transfer belt 24. For example, six image forming units 26 are provided above the intermediate transfer belt 24. The image forming units 26 are each configured to form an image using a toner selected from among developers of special colors such as gold, silver, transparent, white, orange, and so forth, besides developers of basic colors, which are yellow (Y), magenta (M), cyan (C), and black (K).

The image forming units 26 employ, for example, xerography, and includes photosensitive drums 28, a charging device serving as a charging unit that uniformly charges the surface of the photoconductor drums 28, developing devices 32, which develop electrostatic latent images formed on the photoconductor drums 28, and cleaning devices 34. The photoconductor drums 28 are cylindrical image holding bodies that hold toner images (developer images), are uniformly charged by the charging device, and on which electrostatic latent images are formed by laser light emitted by optical scanning devices 36. The electrostatic latent images formed on the photoconductor drums 28 are developed by the developing devices 32 with toners. At positions facing the photoconductor drums 28 with the intermediate transfer belt 24 interposed therebetween, primary transfer rollers 38 are provided. The toner images developed by the developing devices 32 are transferred by the primary transfer rollers 38 to the intermediate transfer belt 24. Note that residual toner, paper dust, and so forth that are attached to the photoconductor drums 28 after the toner image transferring step are removed by the cleaning devices 34.

The toner images transferred by the image forming units 26 to the intermediate transfer belt 24 are secondary-transferred by a secondary transfer roller 48 to paper fed from the paper feeders 14. The paper on which the images are transferred is conveyed to a fixing unit 50, and the images are fixed by heat and pressure, for example. The paper on which the images are fixed in this manner is further cooled by a cooling unit 52. In addition, a reversing unit 54 is provided downstream of the cooling unit 52. The paper is reversed by the reversing unit 54, which is then returned to the secondary transfer roller 48 side to enable double-sided image formation.

Figure 3:
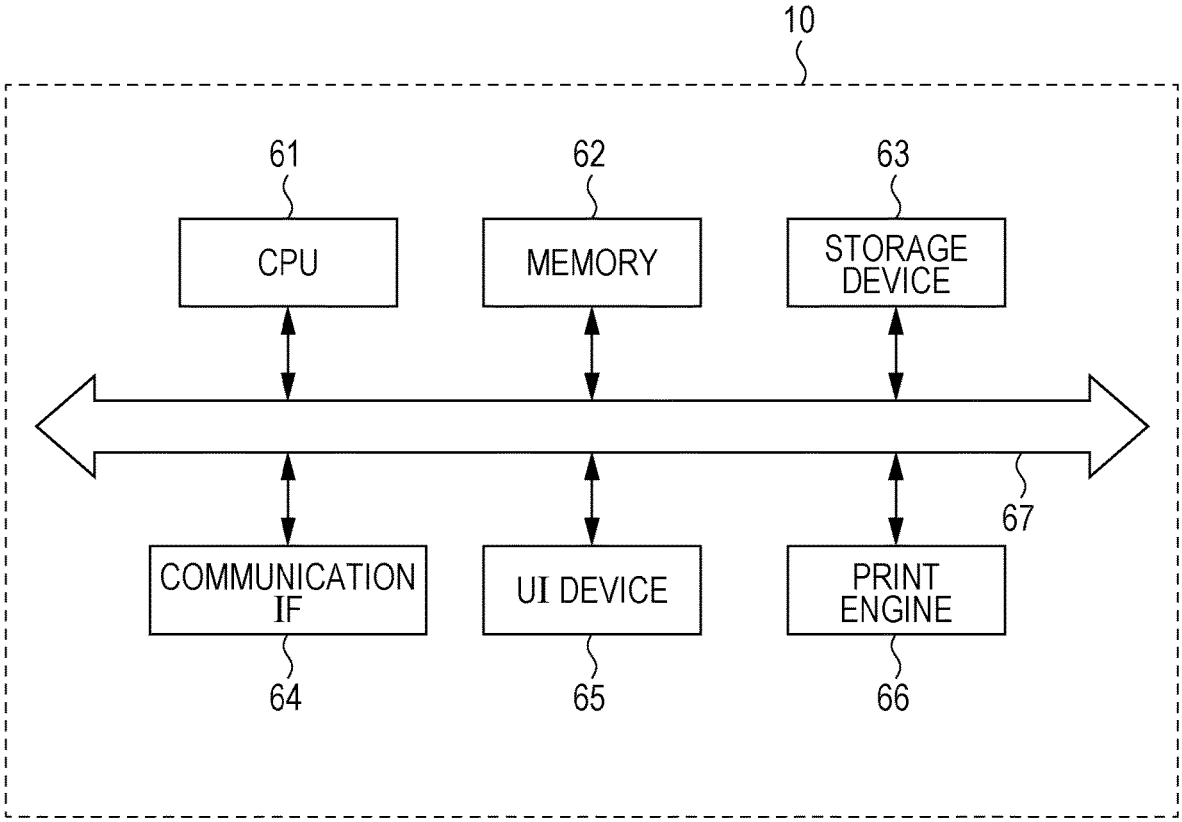
FIG. 3 is a block diagram illustrating the hardware configuration of a control device used in the image forming apparatus according to the exemplary embodiment.

Next, FIG. 3 illustrates the hardware configuration of the image forming apparatus 10 of the exemplary embodiment.

The image forming apparatus 10 includes, as illustrated in FIG. 3, a central processing unit (CPU) 61, memory 62, a storage device 63 such as a hard disk drive (HDD), a communication interface (abbreviated as IF) 64, which performs transmission and reception of data to and from an external apparatus or the like via a network, a user interface (abbreviated as UI) device 65 including a touchscreen or a liquid crystal display and a keyboard, and a print engine 66. These elements are connected to one another via a control bus 67.

The print engine 66 prints an image on paper through the steps of charging, exposure, developing, transfer, and fixing.

The CPU 61 is a processor that executes a certain process based on a control program stored in the memory 62 or the storage device 63, and controls the operation of the image forming apparatus 10. Although the exemplary embodiment has discussed that the CPU 61 reads and executes the control program stored in the memory 62 or the storage device 63, the program may be stored in a storage medium such as a compact-disc read-only memory (CD-ROM) and may be provided to the CPU 61.

Figure 4:
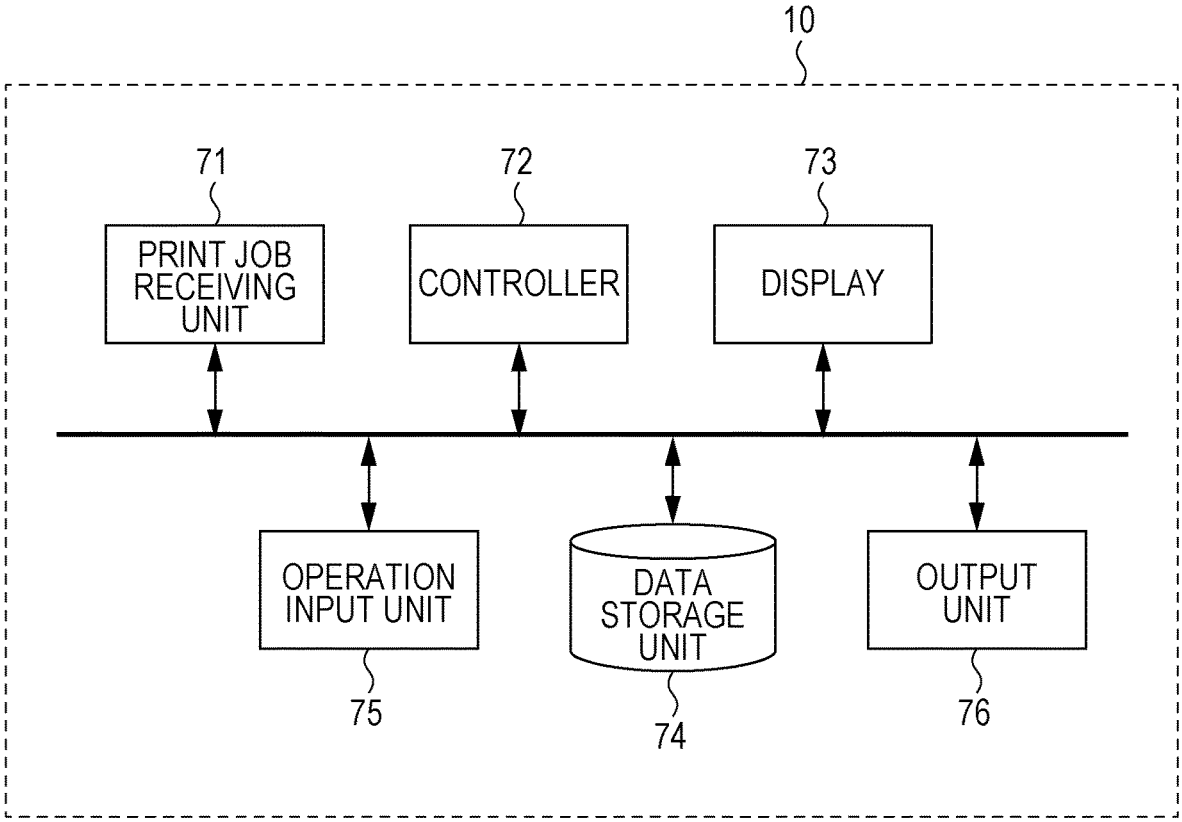
FIG. 4 is a block diagram illustrating the functional configuration of the image forming apparatus according to the exemplary embodiment.

FIG. 4 is a block diagram illustrating the functional configuration of the image forming apparatus 10 realized by execution of the above-mentioned control program.

The image forming apparatus 10 of the exemplary embodiment includes, as illustrated in FIG. 4, a print job receiving unit 71, a controller 72, a display 73, a data storage unit 74, an operation input unit 75, and an output unit 76.

The print job receiving unit 71 receives a print job (an example of a print command) transmitted from a terminal apparatus.

The controller 72 performs control to generate image data serving as print data on the basis of a print job received from the print job receiving unit 71, and output the generated image data from the output unit 76.

The data storage unit 74 stores various types of data including image data generated by the controller 72.

In addition, the data storage unit 74 stores the type of paper and the thickness of paper in association with each other, as illustrated in FIG. 5. Paper has a different thickness depending on the type of paper, such as plain paper, woodfree paper, recycled paper, cardboard, and so forth. By storing in advance the type of paper and the thickness of paper in association with each other in the data storage unit 74, the lowering amount of each paper feed tray 20 may be calculated using the type of paper to be replenished in a corresponding one of the paper feeders 14 and the number of sheets of paper to be replenished, which will be described in detail later.

The output unit 76 outputs an image onto paper under control of the controller 72.

The display 73 is controlled by the controller 72 and displays various types of information on the display screen of the display operating section 18, a terminal apparatus, or the like. The operation input unit 75 receives various types of operation information entered by a user.

In addition, when paper runs out during execution of a print job, the display 73 displays, under control of the controller 72, a warning screen for reporting that to the user. At that time, the number of sheets of paper fed and conveyed is stored in the memory 62 or the like, and the number of sheets of paper deficient for the print job being executed is displayed.

In addition, the display 73 displays, under control of the controller 72, a screen prompting the user to enter the type of paper to be replenished and the number of sheets of paper to be replenished when replenishing paper.

Under control of the controller 72, the operation input unit 75 receives from the user, on the screen displayed on the display 73, an entry of the type of paper to be replenished and the number of sheets of paper to be replenished.

In addition, the controller 72 performs control to raise/lower the paper feed tray 20 automatically or manually when replenishing paper in the paper feeder 14.

When lowering the paper feed tray 20 and replenishing paper, the controller 72 controls the lowering amount of the paper feed tray 20 so that paper for the number of sheets to be replenished may be placed on the paper feed tray 20. Specifically, when lowering the paper feed tray 20 and replenishing paper, the controller 72 controls the lowering amount of the paper feed tray 20 according to the number of sheets of paper to be replenished. More specifically, the controller 72 lowers the paper feed tray 20 by the length obtained by multiplying the thickness associated with the type of paper to be replenished by the number of sheets of paper to be replenished.

In addition, in the case where the operation input unit 75 receives the type of paper to be replenished and the number of sheets of paper to be replenished, the controller 72 controls the lowering amount of the paper feed tray 20 so that the received type of paper for the received number of sheets of paper may be placed on the paper feed tray 20. Specifically, the operation input unit 75 receives the type and the number of sheets of paper to be replenished, and the controller 72 lowers the paper feed tray 20 by the length obtained by multiplying the thickness associated with the received type of paper by the received number of sheets of paper to be replenished.

In addition, in the case where printing is interrupted because paper runs out during execution of a print job and paper is to be replenished, the controller 72 controls the lowering amount of the paper feed tray 20 so that paper for the number of sheets necessary for completing the interrupted print job may be placed on the paper feed tray 20. Specifically, in the case where printing is interrupted because paper runs out during execution of a print job and paper is to be replenished, the controller 72 lowers the paper feed tray 20 by the length obtained by multiplying the thickness associated with the type of paper used in the print job by the number of sheets paper remaining in the print job.

In addition, the controller 72 raises/lowers the paper feed tray 20 in response to an operation on a raising button or a lowering button, which are raising/lowering buttons described later. For example, in response to an operation on the raising button or the lowering button, the controller 72 may further raise/lower the paper feed tray 20 from a stop position based on the above-described lowering amount according to the number of sheets of paper to be replenished.

Figure 6:
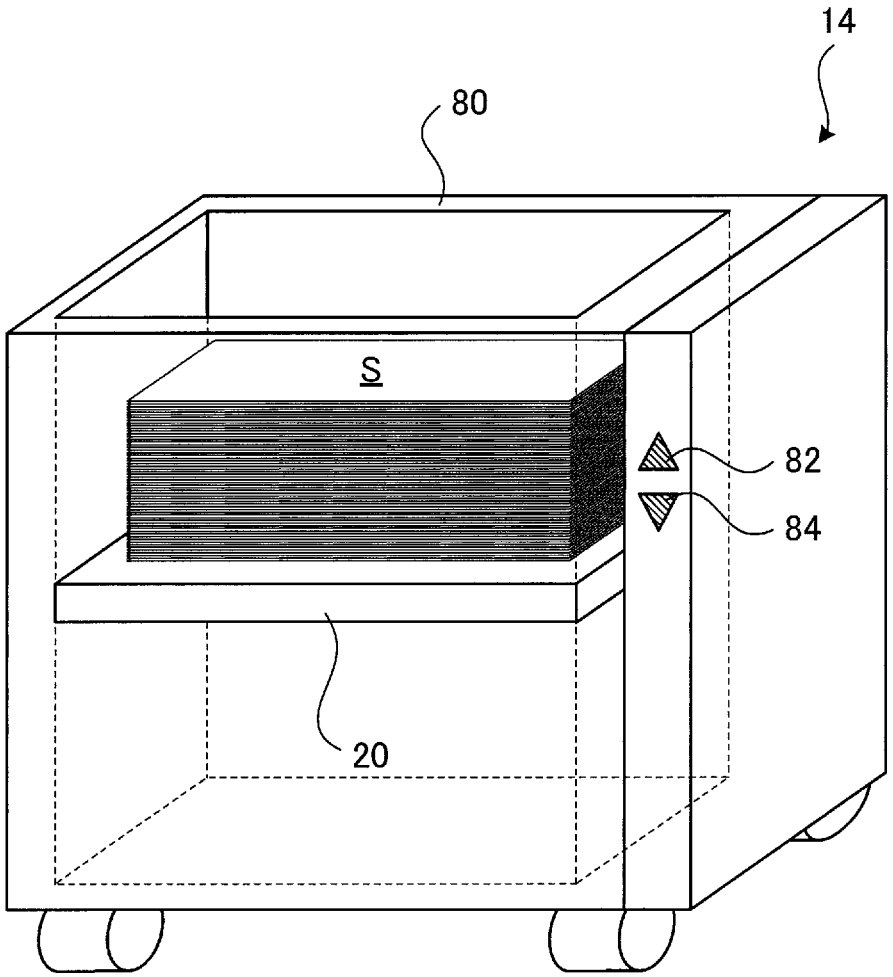
FIG. 6 is a partial perspective view illustrating a paper feeder in the image forming apparatus according to the exemplary embodiment.
Figure 7:
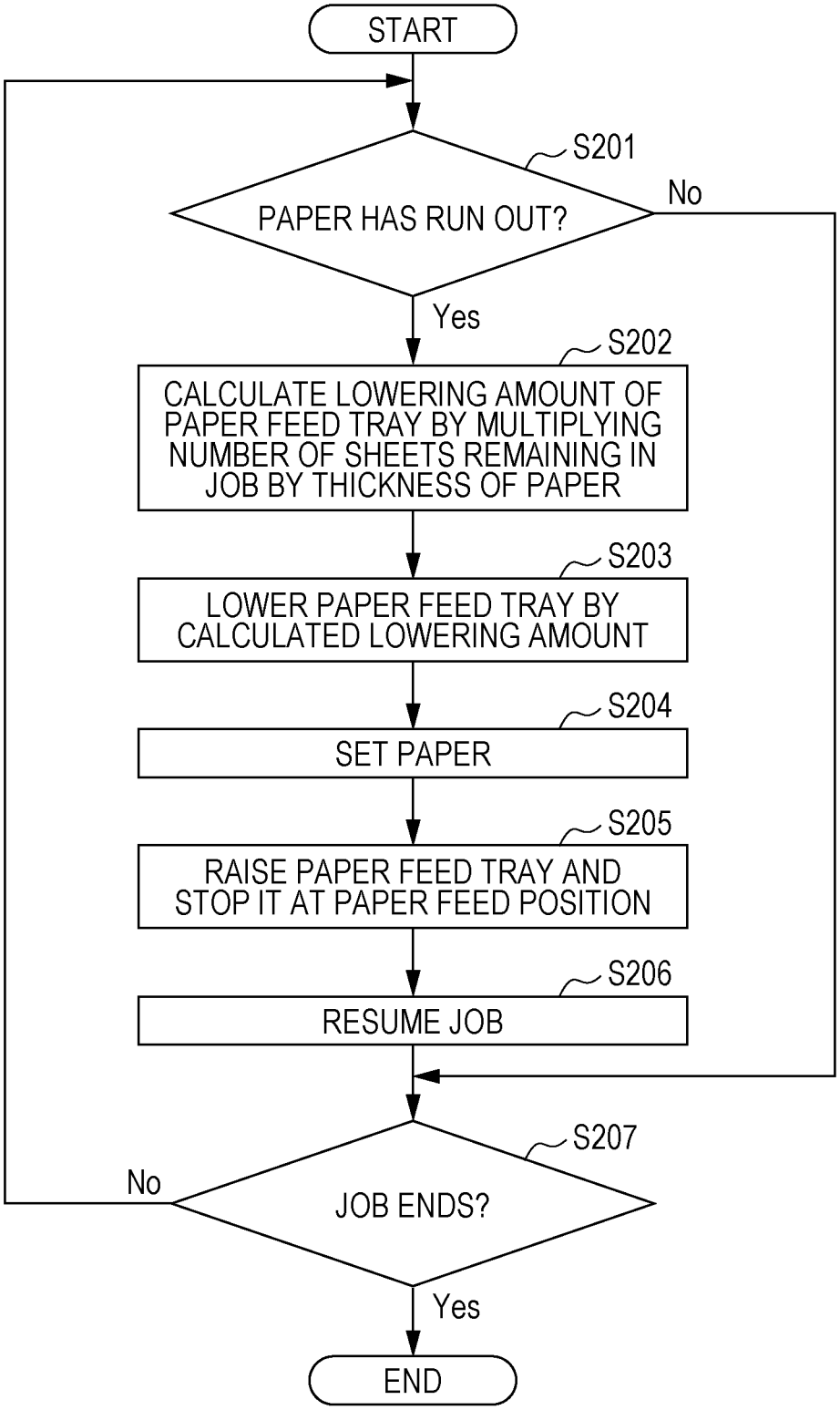
FIG. 7 is a flowchart illustrating the operation of the paper feeder when paper runs out during execution of a print job by the image forming apparatus according to the exemplary embodiment.

FIG. 6 is a partial perspective view illustrating the paper feeder 14.

The paper feeder 14 includes an accommodation section 80, which accommodates paper sheets S, and the paper feed tray 20, on which the paper sheets S are placed in the accommodation section 80. The paper feed tray 20 is held substantially horizontal in the accommodation section 80. The periphery of the paper feed tray 20 is surrounded by the accommodation section 80, and the position of the paper feed tray 20 is visually unrecognizable from the front side.

On the front side of the paper feeder 14, a raising button 82 and a lowering button 84 designating the raising/lowering of the paper feed tray 20 are provided. When operated by the user, the raising button 82 allows the paper feed tray 20 to be raised in a substantially horizontal manner. When operated by the user, the lowering button 84 allows the paper feed tray 20 to be lowered in a substantially horizontal manner. That is, the paper feed tray 20 is configured to be manually raised/lowered in a substantially horizontal manner by pressing the raising button 82 or the lowering button 84.

In addition, the paper feed tray 20 is configured to be automatically lowered in a substantially horizontal manner according to the number of sheets of paper to be replenished, which will be described in detail later.

Next, the operation of the paper feeder 14 in the case where paper runs out during execution of a print job by the image forming apparatus 10 will be described using FIGS. 7 to 9D.

Figure 9A:
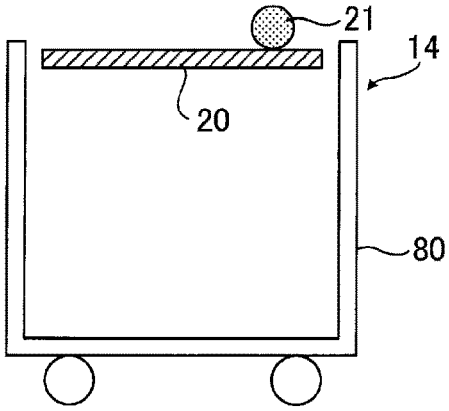
FIGS. 9A to 9D are diagrams for describing the operation of a paper feed tray of the paper feeder in the image forming apparatus according to the exemplary embodiment.

At first, in step S201, when there is no more paper sheets S on the paper feed tray 20 to be fed by the paper feed roller 21 to the image forming section 22, as illustrated in FIG. 9A, the controller 72 detects that the paper has run out.

Figure 8:
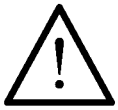
FIG. 8 is a diagram illustrating an example of a display screen of the image forming apparatus when paper runs out during execution of a print job by the image forming apparatus according to the exemplary embodiment.

In response to detection that the paper has run out in step S201, the display 73 displays, under control of the controller 72, a warning screen for reporting to the user that the paper has run out, as illustrated in FIG. 8. At that time, the display 73 displays the number of sheets of paper deficient for completing the interrupted print job.

In step S202, the controller 72 calculates the lowering amount of the paper feed tray 20 for allowing paper for the number of sheets necessary for completing the interrupted print job to be placed on the paper feed tray 20. Specifically, the controller 72 calculates the lowering amount of the paper feed tray 20 by multiplying the number of sheets of paper remaining in the print job by the thickness associated with the type of paper used in the print job.

Figure 9B:
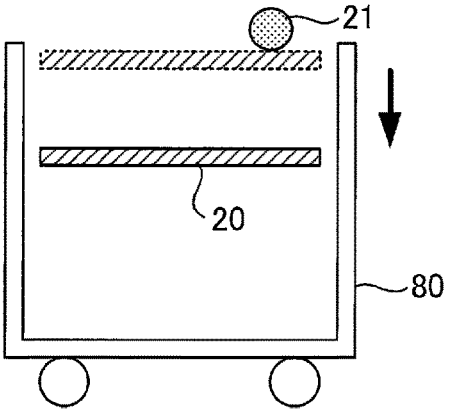

In step S203, in response to pressing of the lowering button 84, the controller 72 lowers the paper feed tray 20 by the lowering amount calculated in step S202, as illustrated in FIG. 9B. In short, in response to pressing of the lowering button 84, the paper feed tray 20 is lowered by the length which allows paper for the number of sheets necessary for completing the interrupted print job to be placed on the paper feed tray 20, and which is calculated by multiplying the number of sheets of paper remaining in the print job by the thickness associated with the type of paper used in the print job.

Specifically, for example, in the case where paper runs out during execution of a print job of outputting an image on plain paper and there are 100 more copies remaining in the print job, the controller 72 multiplies 100 sheets of paper, which are the remaining copies of the print job, by the thickness 0.08 mm per sheet of plain paper to calculate 8 mm as the lowering amount of the paper feed tray 20, and, in response to pressing of the lowering button 84, lowers the paper feed tray 20 by 8 mm from the position indicated in FIG. 9A.

Figure 9C:
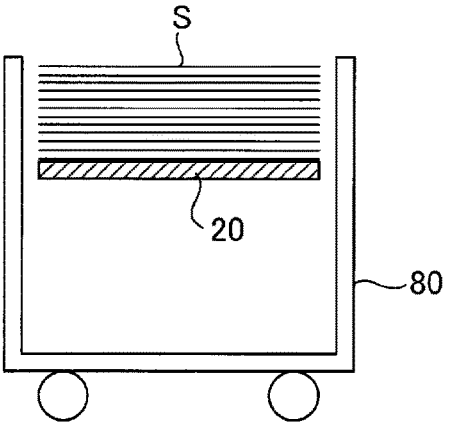

In step S204, the user pulls out the paper feeder 14 from the image forming apparatus main body 12 and sets paper sheets S, as illustrated in FIG. 9C. At this time, the paper feed tray 20 is held at a stop position at which the paper feed tray 20 was stopped after being lowered in step S203. When the lowering button 84 is further pressed, the paper feed tray 20 may be lowered further from the stop position in step S203 in response to this pressing of the lowering button 84. That is, the user may manually raise/lower the paper feed tray 20 using the raising button 82 or the lowering button 84, and may adjust the stop position of the paper feed tray 20 in step S203.

Figure 9D:
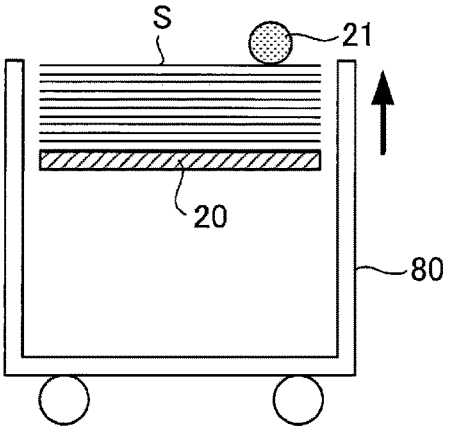
Figure 10:
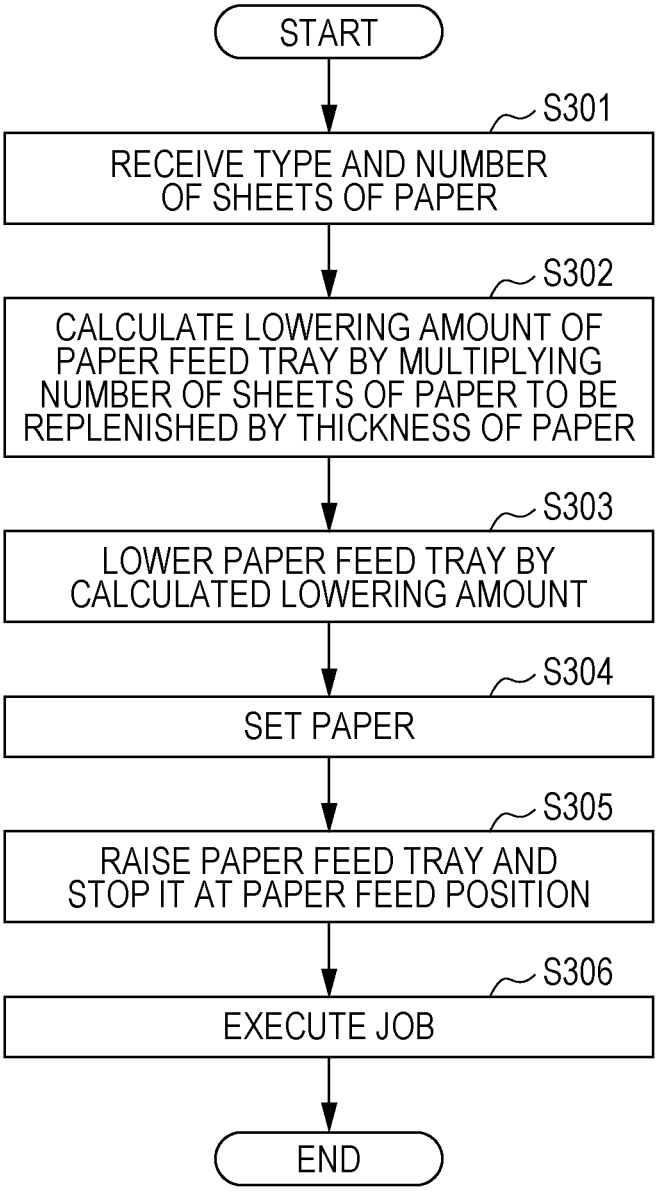
FIG. 10 is a flowchart illustrating the operation of the paper feeder when feeding paper in the image forming apparatus according to the exemplary embodiment.

In step S205, when the user pushes the paper feeder 14 into the image forming apparatus main body 12 and presses the raising button 82, the controller 72 raises the paper feed tray 20 and stops the paper feed tray 20 at a paper feed position at which the paper sheets S placed on top are fed, one sheet at a time, by the paper feed roller 21, as illustrated in FIG. 9D. The paper feed tray 20 is stopped in response to detection by the paper feed roller 21 of the paper sheets S placed on top of the paper feed tray 20.

In step S206, the controller 72 resumes the interrupted print job.

In the case where the print job ends in step S207, the controller 72 ends the process.

Next, the operation of the paper feeder 14 other than in the case where paper runs out during execution of a print job by the image forming apparatus 10 will be described using FIGS. 9A to 11.

Figure 11:
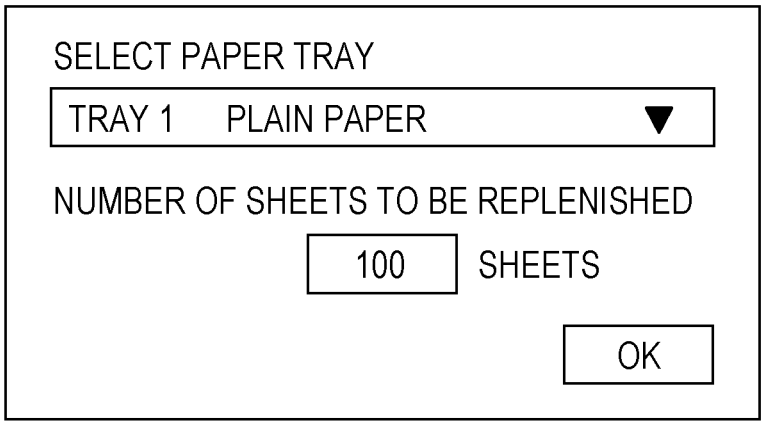
FIG. 11 is a diagram illustrating an example of the display screen of the image forming apparatus when feeding paper in the image forming apparatus according to the exemplary embodiment.

At first, in step S301, the display 73 displays, under control of the controller 72, a screen prompting the user to enter the type of paper to be replenished and the number of sheets of paper to be replenished, and the operation input unit 75 receives an entry from the user under control of the controller 72, as illustrated in FIG. 11.

In step S302, the controller 72 calculates the lowering amount of the paper feed tray 20 for allowing the received type of paper for the received number of sheets of paper to be placed on the paper feed tray 20. Specifically, the controller 72 calculates the lowering amount of the paper feed tray 20 by multiplying the number of sheets of paper to be replenished by the thickness associated with the received type of paper.

In step S303, in response to pressing of the lowering button 84, the controller 72 lowers the paper feed tray 20 by the lowering amount calculated in step S302, as illustrated in FIG. 9B. In short, in response to pressing of the lowering button 84, the paper feed tray 20 is lowered by the length which allows the received type of paper for the received number of sheets of paper to be placed on the paper feed tray 20, and which is calculated by multiplying the number of sheets of paper to be replenished by the thickness associated with the received type of paper.

Specifically, for example, in the case where paper to be replenished in the paper feeder 14, which is received by the operation input unit 75, is 100 sheets of plain paper, as illustrated in FIG. 11, the controller 72 multiplies 100 sheets of plain paper to be replenished by the thickness 0.08 mm per sheet of plain paper to calculate 8 mm as the lowering amount of the paper feed tray 20, and, in response to pressing of the lowering button 84, lowers the paper feed tray 20 by 8 mm from the position indicated in FIG. 9A.

In step S304, the user pulls out the paper feeder 14 from the image forming apparatus main body 12 and sets paper sheets S, as illustrated in FIG. 9C. At this time, the paper feed tray 20 is held at a stop position at which the paper feed tray 20 was stopped after being lowered in step S303. When the lowering button 84 is further pressed, the paper feed tray 20 may be lowered further from the stop position in step S303 in response to this pressing of the lowering button 84. That is, the user may manually raise/lower the paper feed tray 20 using the raising button 82 or the lowering button 84, and may adjust the stop position of the paper feed tray 20 in step S303.

In step S305, when the user pushes the paper feeder 14 into the image forming apparatus main body 12 and presses the raising button 82, the controller 72 raises the paper feed tray 20 and stops the paper feed tray 20 at a paper feed position at which the paper sheets S placed on top are fed, one sheet at a time, by the paper feed roller 21, as illustrated in FIG. 9D. The paper feed tray 20 is stopped in response to detection by the paper feed roller 21 of the paper sheets S placed on top of the paper feed tray 20.

In step S306, the controller 72 executes the print job, and ends the process.

Although the case in which the controller 72 raises the paper feed tray 20 in response to pressing of the raising button 82 and stops the paper feed tray 20 at the paper feed position has been described in the above-described exemplary embodiment, the exemplary embodiment is not limited to this case. Regardless of pressing of the raising button 82, in response to the fact that the paper feeder 14 is pushed into and attached to the image forming apparatus main body 12, the paper feed tray 20 may be raised to the paper feed position.

Although the configuration of performing control using, as the lowering amount of the paper feed tray 20, the length calculated by multiplying the number of sheets of paper to be replenished by the thickness associated with the type of paper to be replenished has been described in the above-described exemplary embodiment, the exemplary embodiment is not limited to this configuration. The amount of movement of a motor for raising/lowering the paper feed tray 20 per unit time may be stored in the data storage unit 74, and control may be performed using, as the lowering amount of the paper feed tray 20, the time calculated by multiplying the number of sheets of paper to be replenished by the thickness associated with the type of paper to be replenished, and dividing the product by the amount of movement of the motor per unit time.

Although the case in which the thickness per sheet which is associated with the type of paper is stored in the data storage unit 74 has been described in the above-described exemplary embodiment, the exemplary embodiment is not limited to this case. The basis weight per sheet which is associated with the type of paper may be stored in the data storage unit 74, and the basis weight per sheet may be converted to the thickness per sheet to calculate the lowering amount of the paper feed tray 20.

Next, an image forming apparatus that performs control to uniformly lower the paper feed tray 20 to the bottom end regardless of the number of sheets of paper to be replenished serves as a comparative example, and the operation of a paper feeder 140 when replenishing paper in the image forming apparatus of the comparative example will be described using FIGS. 12A to 12D.

Figure 12A:
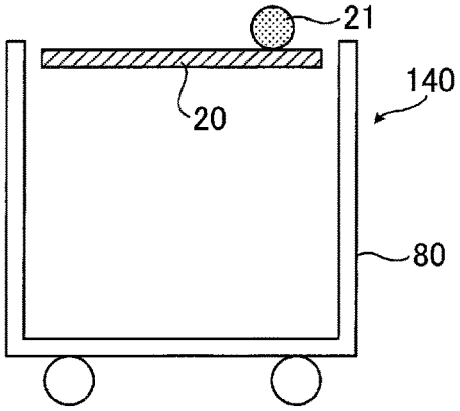
FIGS. 12A to 12D are diagrams for describing the operation of a paper feed tray of a paper feeder in an image forming apparatus according to a comparative example.
Figure 12B:
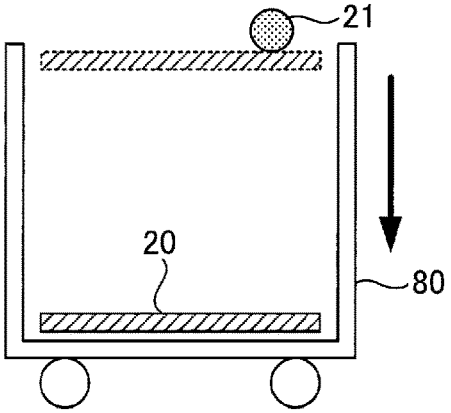
Figure 12C:
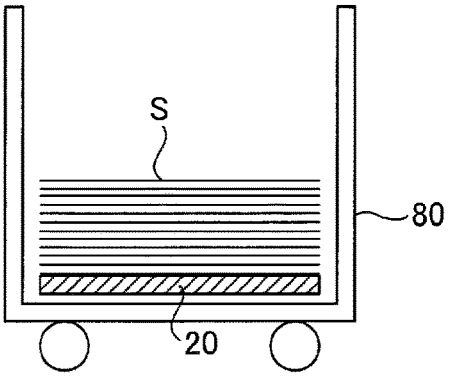
Figure 12D:
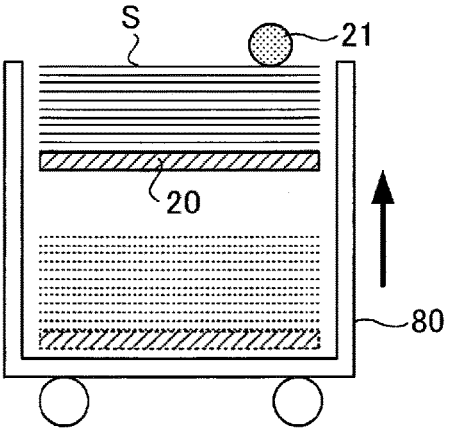

When replenishing paper in the image forming apparatus of the comparative example, as illustrated in FIGS. 12A and 12B, the paper feed tray 20 is lowered from the paper feed position at the top end to the bottom end position in the accommodation section 80. That is, in the comparative example, the paper feed tray 20 is uniformly lowered to the stop position at the bottom end, regardless of the number of sheets of paper to be replenished. However, as illustrated in FIG. 12C, in the case of replenishing a small number of paper sheets S, if the paper feed tray 20 is uniformly lowered to the stop position at the bottom end, it takes a longer time than needed to raise/lower the paper feed tray 20, leading to a longer replenishing time for replenishing the paper sheets S.

According to the image forming apparatus of the exemplary embodiment, the time for raising/lowering the paper feed tray may be shortened, and the replenishment time for replenishing paper may be shortened, as compared to the above-mentioned comparative example. In particular, in the case of replenishing several sheets of paper for test printing or reprinting using the paper feeder 14 which accommodates a large amount of paper, the paper feed tray 20 may be lowered by an amount corresponding to the number of sheets of paper to be replenished, without being lowered from the paper feed position more than necessary, thereby shortening the time for raising/lowering the paper feed tray 20 and shortening the replenishment time for replenishing paper.

In the embodiments above, the term "processor" refers to hardware in a broad sense. Examples of the processor include general processors (e.g., CPU: Central Processing Unit) and dedicated processors (e.g., GPU: Graphics Processing Unit, ASIC: Application Specific Integrated Circuit, FPGA: Field Programmable Gate Array, and programmable logic device).

In the embodiments above, the term "processor" is broad enough to encompass one processor or plural processors in collaboration which are located physically apart from each other but may work cooperatively. The order of operations of the processor is not limited to one described in the embodiments above, and may be changed.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A paper feeder comprising:

a processor configured to, in a case of lowering a paper feed tray on which paper is placed in an accommodation section that accommodates paper and replenishing paper, the paper feed tray being controlled to be raised/lowered in a case of replenishing paper:

(1) calculating a lowering amount to lower the paper tray based on a number of sheets of paper to be replenished so that the lowering amount varies based on the number of sheets of paper to be replenished; and (2) controlling the paper tray so that the paper tray is moved the lowering amount.

2. The paper feeder according to claim 1, wherein the processor is configured to lower the paper feed tray based on a thickness associated with a type of paper to be replenished.

3. The paper feeder according to claim 2, wherein the processor is configured to receive a type and a number of sheets of paper to be replenished.

4. The paper feeder according to claim 1, wherein, in a case where printing is interrupted because paper runs out during execution of a print process and paper is to be replenished, the processor is configured to lower the paper feed tray using a number of sheets of paper remaining in the printing process as the number of sheets of paper to be replenished.

5. The paper feeder according to claim 1, wherein, in response to an operation on raising/lowering buttons designating raising/lowering of the paper feed tray, the processor is configured to control the paper feed tray to be further raised/lowered from a stop position based on the lowering amount according to the number of sheets of paper to be replenished.

6. The paper feeder according to claim 1, wherein the processor is configured to control the lowering amount of the paper feed tray for allowing paper for the number of sheets of paper to be replenished to be placed on the paper feed tray in the case of lowering the paper feed tray and replenishing paper.

7. The paper feeder according to claim 6, wherein, on receipt of a type and a number of sheets of paper to be replenished, the processor is configured to control the lowering amount of the paper feed tray for allowing the received type of paper for the received number of sheets of paper to be placed on the paper feed tray.

8. The paper feeder according to claim 6, wherein, in a case where printing is interrupted because paper runs out during execution of a print process and paper is to be replenished, the processor is configured to control the lowering amount of the paper feed tray for allowing paper for a number of sheets of paper necessary for completing the interrupted print process to be placed on the paper feed tray.

9. An image forming apparatus comprising:

an accommodation section that accommodates paper;

a paper feed tray on which paper is placed in the accommodation section, the paper feed tray being controlled to be raised/lowered in a case of replenishing paper;

a paper feed roller that feeds paper placed on top of the paper feed tray, one sheet at a time;

an image output unit that outputs an image onto the fed sheet of paper; and a processor configured to, in a case of lowering the paper feed tray and replenishing paper:

(1) calculating a lowering amount to lower the paper tray based on a number of sheets of paper to be replenished so that the lowering amount varies based on the number of sheets of paper to be replenished; and (2) controlling the paper tray so that the paper tray is moved the lowering amount.

10. A non-transitory computer-readable storage medium storing a program causing a computer to execute a process, the process comprising:

in a case of lowering a paper feed tray on which paper is placed in an accommodation section that accommodates paper and replenishing paper, the paper feed tray being controlled to be raised/lowered in a case of replenishing paper, (1) calculating a lowering amount to lower the paper tray based on a number of sheets of paper to be replenished so that the lowering amount varies based on the number of sheets of paper to be replenished; and (2) controlling the paper tray so that the paper tray is moved the lowering amount.

* * * * *